US012698910B2

(12) United States Patent
Welch et al.

(10) Patent No.: US 12,698,910 B2
(45) Date of Patent: Aug. 4, 2026

(54) CONDITIONING SYSTEM INCLUDING VAPOR COMPRESSION SYSTEM AND HUMIDITY CONTROL SYSTEM

(71) Applicant: Copeland LP, Sidney, OH (US)

(72) Inventors: Andrew M. Welch, Franklin, OH (US); Winfield S. Morter, Dayton, OH (US)

(73) Assignee: Copeland LP, Sidney, OH (US)

( * ) Notice: Subject to any disclaimer, the term of this patent is extended or adjusted under 35 U.S.C. 154(b) by 496 days.

(21) Appl. No.: 17/644,887

(22) Filed: Dec. 17, 2021

(65) Prior Publication Data

US 2023/0194108 A1 Jun. 22, 2023

(51) Int. Cl.
*F24F 3/14* (2006.01)
*F24F 11/00* (2018.01)

(52) U.S. Cl.
CPC ..... *F24F 3/1417* (2013.01); *F24F 11/0008* (2013.01)

(58) Field of Classification Search
CPC ..... F25B 30/04; F25B 25/00; F25B 29/006; F24F 3/147; F24F 3/1417; F24F 3/14; F24F 2003/1458; F24F 11/86; F24F 11/65
See application file for complete search history.

(56) References Cited

U.S. PATENT DOCUMENTS 4,744,414 A * 5/1988 Schon ..... F28F 21/065 165/905
4,941,324 A 7/1990 Peterson et al.
4,984,434 A 1/1991 Peterson et al.
7,260,945 B2 8/2007 Landry
8,268,060 B2 9/2012 Hargis et al.
9,267,696 B2 2/2016 Gerlach et al.
9,518,765 B2 12/2016 Laughman et al.
10,619,867 B2 4/2020 Vandermeulen
(Continued)

FOREIGN PATENT DOCUMENTS

EP 3120083 B1 7/2020
WO 2017185005 A1 10/2017
(Continued)

OTHER PUBLICATIONS

International Search Report and Written Opinion for App. No. PCT/US2022/081358, mailed Mar. 23, 2023, 13 pages.

*Primary Examiner* — Jianying C Atkisson
*Assistant Examiner* — Meraj A Shaikh
(74) *Attorney, Agent, or Firm* — Armstrong Teasdale LLP

(57) ABSTRACT

A conditioning system includes a vapor compression system and a humidity control system. The vapor compression system includes an evaporator, a condenser, a first fan that produces a first airflow across the evaporator toward a conditioned interior space, and a second fan that produces a second airflow from the condenser toward an exterior space. The humidity control system includes a first mass exchange device positioned in the first airflow, a second mass exchange device positioned in the second airflow, and a heat exchanger in fluid communication with both mass exchange devices. The heat exchanger includes a first path and a second path that are thermally coupled and that provide liquid desiccant between the first and second mass exchange devices. The first and second mass exchange devices each include a plurality of cavities configured to permit liquid desiccant to flow therethrough.

20 Claims, 6 Drawing Sheets

(56) References Cited

U.S. PATENT DOCUMENTS

| | | | | |
|---|---|---|---|---|
| 10,655,870 | B2 | 5/2020 | Lowenstein | |
| 10,731,876 | B2 | 8/2020 | Vandermeulen | |
| 2003/0029185 | A1* | 2/2003 | Kopko | F24F 1/0087 62/271 |
| 2003/0121271 | A1* | 7/2003 | Dinnage | F24F 3/1405 62/271 |
| 2008/0302357 | A1* | 12/2008 | DeNault | F24S 30/20 126/704 |
| 2015/0260420 | A1 | 9/2015 | Forkosh | |
| 2017/0241654 | A1 | 8/2017 | Lowenstein | |
| 2017/0292722 | A1 | 10/2017 | Vandermeulen | |
| 2019/0145640 | A1 | 5/2019 | Vandermeulen et al. | |
| 2019/0285290 | A1 | 9/2019 | Woods et al. | |
| 2020/0096241 | A1* | 3/2020 | Vandermeulen | F25B 30/04 |

FOREIGN PATENT DOCUMENTS

| | | | |
|---|---|---|---|
| WO | 2019162949 | A1 | 8/2019 |
| WO | 2020026040 | A1 | 2/2020 |
| WO | 2020026084 | A2 | 2/2020 |

* cited by examiner

CONDITIONING SYSTEM INCLUDING VAPOR COMPRESSION SYSTEM AND HUMIDITY CONTROL SYSTEM

FIELD OF THE DISCLOSURE

The field of the disclosure relates generally to heating, ventilation, and air conditioning (HVAC) systems, and more specifically, to the use of humidity control systems in HVAC systems.

BACKGROUND

The vapor compression cycle is widely used in air conditioning systems to regulate the temperature and humidity of an indoor space. Typically, air is cooled below its dew point temperature to allow moisture in the air to condense on an evaporator coil, thereby dehumidifying the air. Since this process often leaves the dehumidified air at an uncomfortably cold temperature, the air is then reheated to a temperature more comfortable to a user. The process of overcooling and reheating the air can become very energy-intensive and costly, particularly since the reheating process adds an additional heat load to the evaporator.

In some applications, vapor compression systems are used in parallel with liquid desiccant dehumidification systems to remove moisture from the air without cooling it below its dew point temperature. Such systems include a liquid desiccant loop that absorbs moisture from the cooled indoor air and exhausts it into the warm outdoor environment. However, the liquid desiccants used in these systems are often highly corrosive, and any carry-over of desiccant into the air stream can damage other parts of the system. Thus, there is a need for a liquid desiccant system that can effectively control the humidity of an indoor space while keeping the liquid desiccant fully isolated.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of the present disclosure is directed to a conditioning system including a vapor compression system and a humidity control system. The vapor compression system includes an evaporator, a condenser, a first fan, and a second fan. The first fan produces a first airflow across the evaporator toward a conditioned interior space, and the second fan produces a second airflow from the condenser toward an exterior space. The humidity control system includes a first mass exchange device positioned in the first airflow, a second mass exchange device positioned in the second airflow, and a liquid desiccant heat exchanger coupled in fluid communication with the first and second mass exchange devices. The liquid desiccant heat exchanger includes a first path and a second path that are thermally coupled. The first path provides liquid desiccant in a first direction from the first to the second mass exchange device, and the second path provides liquid desiccant in a second direction from the second to the first mass exchange device. The first and second mass exchange devices each include a plurality of cavities configured to permit a flow of the liquid desiccant therethrough.

Another aspect of the present disclosure is directed to a humidity control system for use in a vapor compression system that includes an evaporator and a condenser. The humidity control system includes a first mass exchange device, a second mass exchange device, and a liquid desiccant heat exchanger coupled in fluid communication with the first and second mass exchange devices. The first mass exchange device is configured to be positioned in a first airflow from the evaporator to a conditioned interior space. The second mass exchange device is configured to be positioned in a second airflow from the condenser to an exterior space. The liquid desiccant heat exchanger includes a first path and a second path that are thermally coupled. The first path provides liquid desiccant in a first direction from the first mass exchange device to the second mass exchange device. The second path provides liquid desiccant in a second direction from the second mass exchange device to the first mass exchange device. The first and second mass exchange devices each include at least one cavity configured to permit a flow of liquid desiccant therethrough.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

For conciseness, examples will be described with respect to a conditioning system that cools and dehumidifies an indoor space. However, the systems described herein may be applied to any suitable system for regulating the temperature and humidity of a space, including those that heat and/or humidify a space. The temperature and humidity of an indoor space can be independently regulated using a conditioning system that includes a vapor compression system and a humidity control system. The vapor compression system cools and pre-conditions the air, and the humidity control system uses a liquid desiccant loop to dehumidify the air by absorbing moisture from the indoor space and releasing it into an outdoor space.

Figure 1:
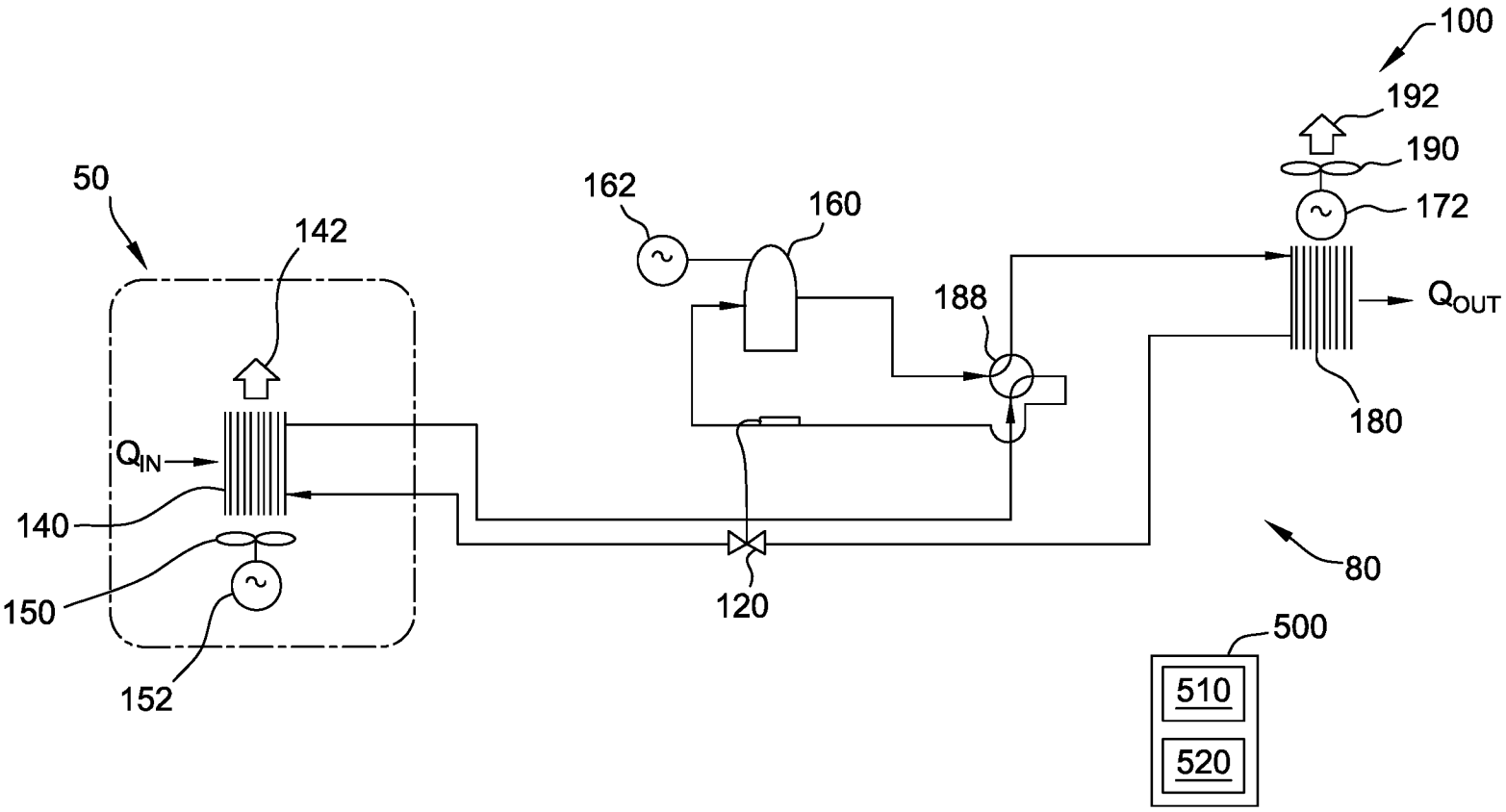
FIG. 1 is a schematic view of a vapor compression system.

FIG. 1 is a schematic diagram of a vapor compression system 100 for cooling a conditioned interior space 50 with an exterior space 80 around it. The vapor compression system 100 has a single, closed refrigerant loop that includes an expansion device 120, an evaporator 140 (sometimes referred to as an indoor heat exchanger), a compressor 160, and a condenser 180 (sometimes referred to as an outdoor heat exchanger). Refrigerant enters the expansion device 120 as a high-pressure, low-temperature liquid. The expansion device 120 reduces the pressure of the refrigerant such that it exits as low-pressure, low-temperature liquid. In some embodiments, the pressure may be reduced until the liquid refrigerant's current temperature becomes the boiling point temperature at that pressure, and the refrigerant becomes a two-phase mixture as some of the liquid refrigerant boils and turns into a gas. The expansion device 120 may be any type of expansion device that allows the vapor compression system 100 to function as descried herein, for example and without limitation, a fixed orifice, a thermal expansion valve, or an electronic expansion valve.

The expansion device 120 is fluidly coupled to the evaporator 140, which receives low-pressure, low-temperature liquid refrigerant at its inlet. In the evaporator 140, the refrigerant absorbs heat $Q_{in}$ from the conditioned interior space 50 to change phase from a liquid to a gas. A first fan 150 produces a first airflow 142 across the evaporator 140 toward the conditioned interior space 50, thereby cooling the conditioned interior space 50. In some embodiments, the conditioned interior space 50 is cooled to a temperature greater than the dew point temperature of the air. The first fan 150 may be driven by a first variable frequency drive (VFD) 152 or any other suitable motor.

The evaporator 140 is fluidly coupled to the compressor 160, where it enters as a low-pressure, low-temperature gas. The compressor 160 is operable to compress the refrigerant by increasing the pressure of the refrigerant, for example, by adding kinetic energy to the refrigerant and converting it to pressure rise. The compressor 160 may be any suitable compression device that allows the vapor compression system 100 to function as described herein, for example and without limitation, a dynamic compressor, a centrifugal compressor, an axial compressor, a scroll compressor, a rotary compressor, a screw compressor, a single-stage compressor, or a multi-stage compressor. The compressor may be driven by a second VFD 162 or any other suitable motor. The refrigerant exits the compressor 160 as a high-pressure, high-temperature gas.

The compressor 160 is fluidly coupled to the condenser 180, where heat $Q_{out}$ is removed at a constant pressure to condense the refrigerant into a high-pressure, saturated or subcooled liquid. A second fan 190 produces a second airflow 192 from the condenser 180 toward the exterior space 80, thereby exhausting warm air toward the exterior space 80. The second fan 190 may be driven by a third VFD 172 or any other suitable motor. The condenser 180 is fluidly coupled to the expansion device 120, and the cycle begins again.

In some embodiments, the vapor compression system 100 shown in FIG. 1 can be used as a heating system, rather than as a cooling system. In such embodiments, a position of a four-way valve 188 can be switched to reverse the flow of refrigerant through the vapor compression system 100. As a result, the condenser 180 functions as an evaporator for absorbing heat from the exterior space 80, and the evaporator 140 functions as a condenser for heating the conditioned interior space 50.

Figure 2:
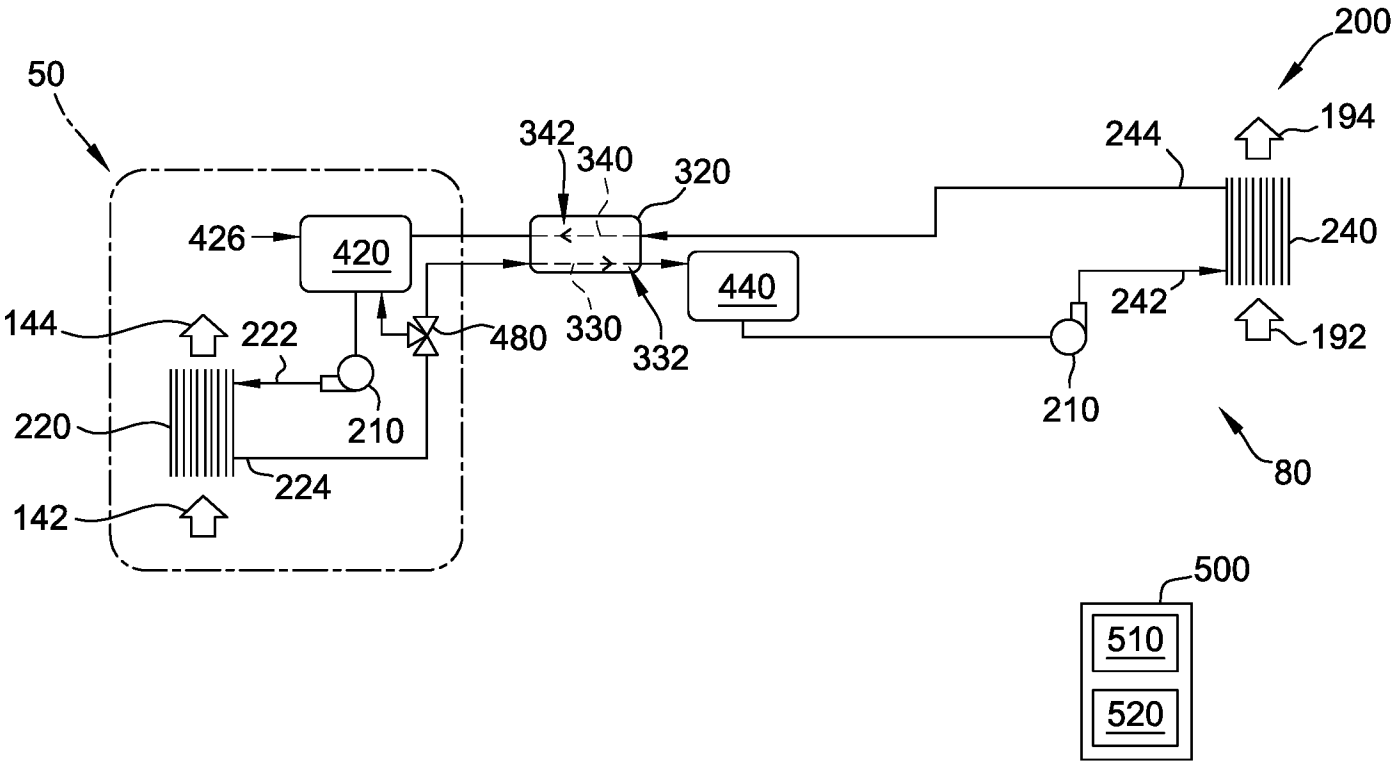
FIG. 2 is a schematic view of a humidity control system that can be used in combination with the vapor compression system shown in FIG. 1.
Figure 3:
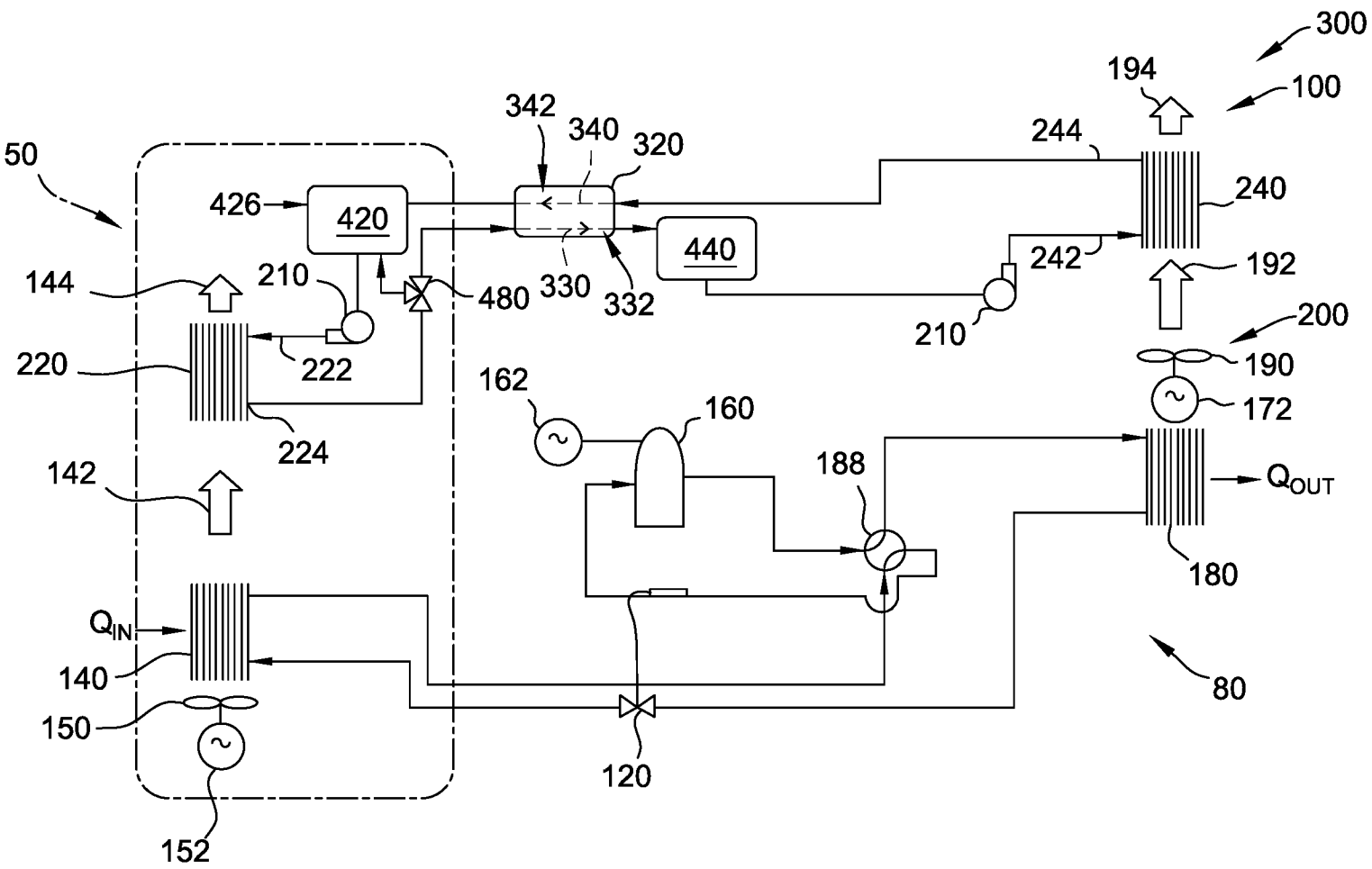
FIG. 3 is a schematic view of a conditioning system that includes the vapor compression system shown in FIG. 1 and the humidity control system shown in FIG. 2.

The vapor compression system 100 may be used in combination with a humidity control system 200 (FIG. 2) to form a conditioning system 300 (FIG. 3). The humidity control system 200 has a single fluid loop configured to permit a liquid desiccant to flow therethrough to reduce the humidity in the interior space 50 by transferring moisture from the conditioned interior space 50 to the exterior space 80. Any suitable liquid desiccant can be used that allows the humidity control system 200 to function as described herein, for example and without limitation, lithium chloride or calcium chloride. When cooled, the liquid desiccant can absorb moisture from the air to dehumidify and remove latent heat from the conditioned interior space 50. When reheated, the liquid desiccant releases moisture, transferring it back into the air. Since the liquid desiccant's effectiveness is reduced as it becomes diluted with water, heating it up to transfer moisture back into the air allows it to be regenerated and reused. Although described in connection with the vapor compression system 100, the humidity control system may be used as a stand-alone humidity control system without the vapor compression system 100, or may be used in connection with any other suitable HVAC system.

With reference to FIGS. 2 and 3, the humidity control system 200 includes a first mass exchange device 220 for dehumidifying the conditioned interior space 50, a second mass exchange device 240 for regenerating the liquid desiccant, and a liquid desiccant heat exchanger 320 coupled in fluid communication with both the first mass exchange device 220 and the second mass exchange device 240. The first mass exchange device 220 is positioned in the first airflow 142 between the evaporator 140 and the conditioned interior space 50. The evaporator 140 cools the first airflow 142, causing its relative humidity to increase. As the first airflow 142 passes through the first mass exchange device 220, the liquid desiccant in the first mass exchange device 220 absorbs moisture from the air. The first airflow 142 is thereby dehumidified in the first mass exchange device 220 and enters the conditioned interior space as a conditioned airflow 144. The second mass exchange device 240 is positioned in the second airflow 192 between the condenser 180 and the exterior space 80. The condenser 180 warms the second airflow 192, causing its relative humidity to decrease. As the second airflow 192 passes through the second mass exchange device 240, the liquid desiccant in the second mass exchange device 240 expels moisture into the air. The liquid desiccant is thereby regenerated, and the second airflow 192 enters the exterior space 80 as an exhaust flow 194.

Figure 4:
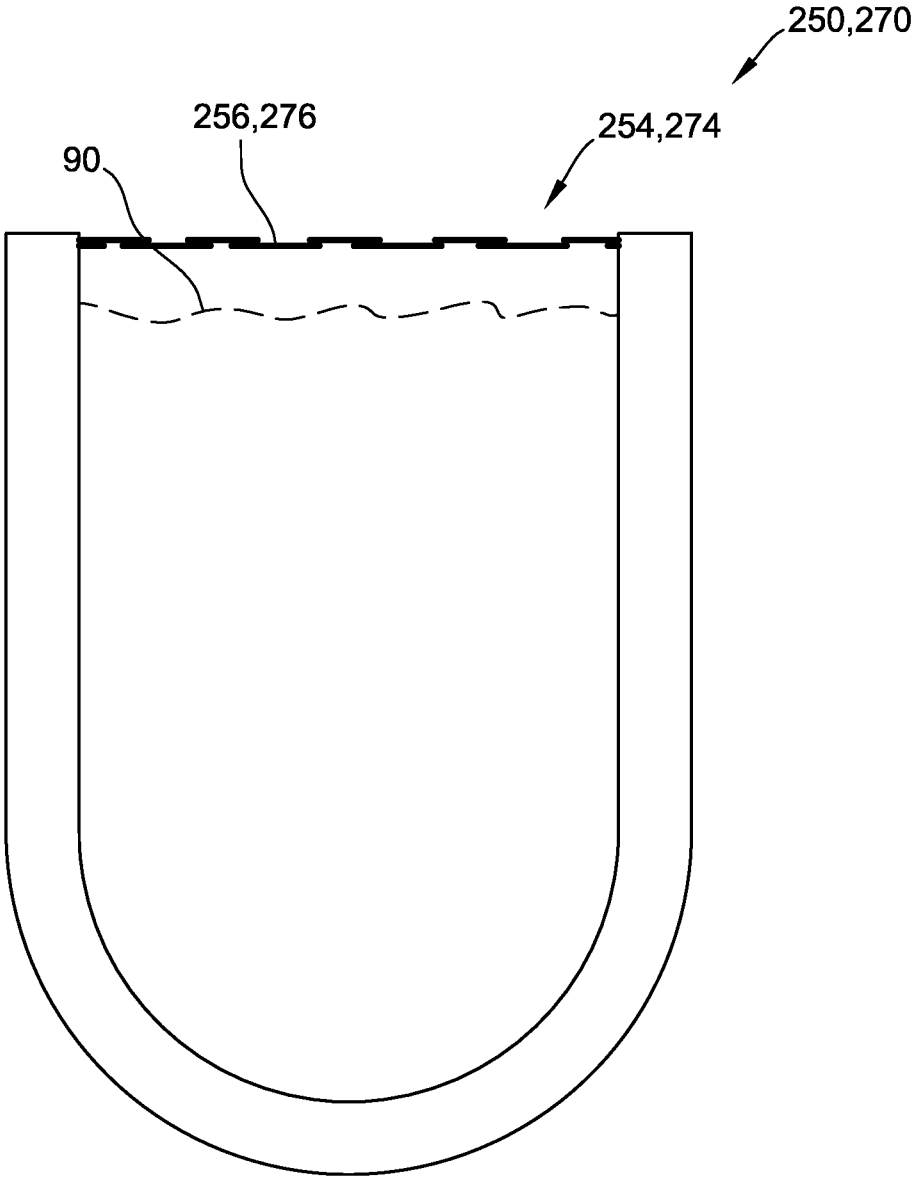
FIG. 4 is a cross-sectional view of a first or second cavity of a mass exchange device included in the humidity control system shown in FIG. 2.
Figure 5:
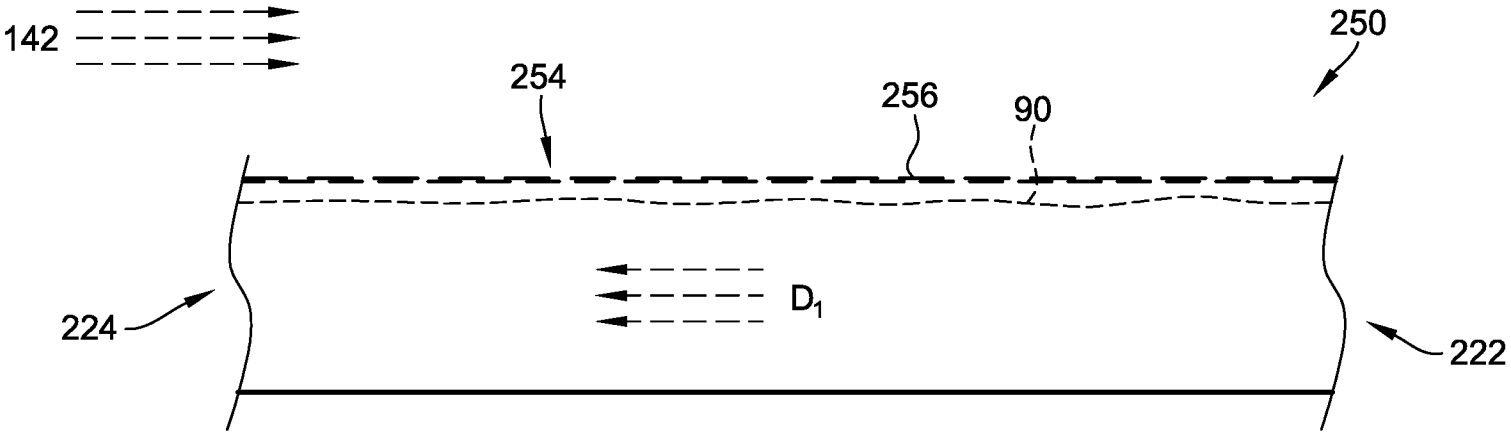
FIG. 5 is a side view of the first cavity shown in FIG. 4.

The first mass exchange device 220 has an inlet 222 and an outlet 224 and, with reference to FIGS. 4 and 5, further includes a plurality of first cavities 250 configured to permit liquid desiccant to flow therethrough. Similarly, the second mass exchange device 240 has an inlet 242 and an outlet 244 and, with reference to FIGS. 4 and 6, further includes a plurality of second cavities 270 configured to permit liquid desiccant to flow therethrough. The cavity illustrated in FIG. 4 may be either of the first and second cavities 250, 270. The cavity 250, 270 illustrated in FIG. 4 has a U-shaped cross-section, but the first and second cavities 250, 270 may have any shape or cross-section that allows their respective mass exchange device 220, 240 to function as described herein, for example and without limitation, a rectangular, semi-circular, or V-shaped cross-section. Each first cavity 250 may have the same cross-section, or different first cavities 250 may have different cross-sections. Each second cavity 270 may have the same cross-section, or different second cavities 270 may have different cross-sections. Each second cavity 270 may additionally have the same cross-section or a different cross-section than each first cavity 250.

With reference to FIG. 5, liquid desiccant flows through each of the plurality of first cavities 250 in a direction $D_1$ opposite the direction of the first airflow 142. In further embodiments, the liquid desiccant may flow in the same direction as the first airflow 142. Each first cavity 250 defines an open portion 254 positioned to be exposed to the first airflow 142. A surface 90 of the liquid desiccant is disposed proximate the open portion 254. In the U-shaped first cavity 250 shown in FIG. 4, the open portion 254 is defined by the upper, non-rounded portion of the U-shape that is not bounded by a wall.

A first vapor permeable membrane 256 covers the open portion 254 of each first cavity 250 to separate the surface 90 of the liquid desiccant from the first airflow 142. The first vapor permeable membrane 256 can include a plurality of pores that are sized to allow water vapor molecules to pass through while prohibiting the passage of larger molecules, such as molecules of the liquid desiccant. Thus, the first vapor permeable membrane 256 allows moisture from the first airflow 142 to pass through the membrane 256 and be absorbed by the liquid desiccant to dehumidify the air. The first vapor permeable membrane 256 also prevents liquid desiccant from leaking out of the first cavity 250 and into the first airflow 142.

Figure 6:
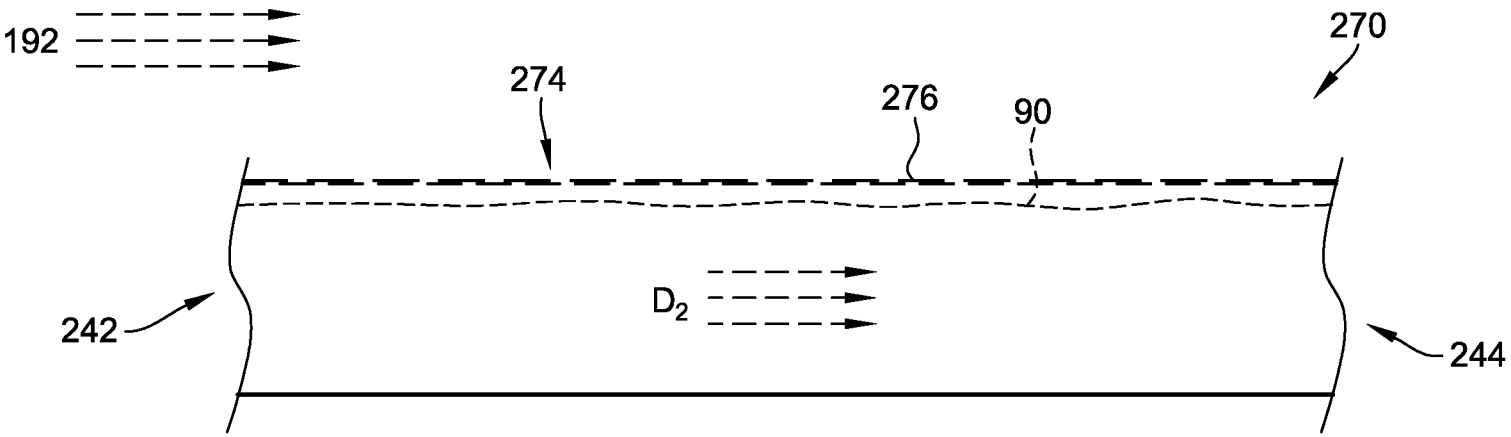
FIG. 6 is a side view of the second cavity shown in FIG. 4.

With reference to FIG. 6, liquid desiccant flows through each of the plurality of second cavities 270 in a direction $D_2$ that is parallel to the direction of the second airflow 192. In further embodiments, the liquid desiccant may flow in the opposite direction as the second airflow 192. Each second cavity 270 defines an open portion 274 positioned to be exposed to the second airflow 192. The surface 90 of the liquid desiccant is disposed proximate the open portion 274. In the U-shaped second cavity 270 shown in FIG. 4, the open portion 274 is defined by the upper, non-rounded portion of the U-shape that is not bounded by a wall.

A second vapor permeable membrane 276 covers the open portion 274 of each second cavity 270 to separate the surface 90 of the liquid desiccant from the second airflow 192. The second vapor permeable membrane 276 can include a plurality of pores that are sized to allow water vapor molecules to pass through while prohibiting the passage of larger molecules, such as molecules of liquid desiccant. Thus, the second vapor permeable membrane 276 allows moisture in the liquid desiccant to pass through the membrane 276 and be released into the second airflow 192 to regenerate the liquid desiccant. The second vapor permeable membrane 276 also prevents any liquid desiccant from leaking out of the second cavity 270 and into the second airflow 192.

With reference to FIGS. 2 and 3, the first and second mass exchange devices 220, 240 are coupled in fluid communication with the liquid desiccant heat exchanger 320. The heat exchanger 320 includes a first path 330 and a second path 340 that are adjacent and thermally coupled to one another. The first path 330 of the heat exchanger 320 is in fluid communication with both the outlet 224 of the first mass exchange device 220 and the inlet 242 of the second mass exchange device 240. The liquid desiccant exiting the first mass exchange device 220 is cold from thermal contact with the first airflow 142 and flows through the first path 330 of the heat exchanger 320 in a first direction 332 oriented from the first mass exchange device 220 to the second mass exchange device 240.

The second path 340 of the heat exchanger 320 is in fluid communication with both the outlet 244 of the second mass exchange device 240 and the inlet 222 of the first mass exchange device 220. The liquid desiccant exiting the second mass exchange device 240 is warm from thermal contact with the second airflow 192 and flows through the second path 340 in a second direction 342 oriented from the second mass exchange device 240 to the first mass exchange device 220. The thermal contact between the first path 330 and the second path 340 causes the warm liquid desiccant in the second path 340 to be pre-cooled prior to entering the first mass exchange device 220, increasing its capacity to absorb moisture from the first airflow 142. The thermal contact between the two paths 330, 340 also causes the cold liquid desiccant in the first path 330 to be pre-heated prior to entering the second mass exchange device 240, improving its ability to release moisture into the second airflow 192.

In the embodiment illustrated in FIG. 2, the heat exchanger 320 is in a counterflow configuration, and the first and second directions 332, 342 are opposite, parallel directions. The counterflow configuration improves the effectiveness of the heat transfer between the first and second paths 330, 340. In further embodiments, the first and second directions 332, 342 may be perpendicular, parallel, or in any other suitable orientation.

The humidity control system 200 further includes at least one liquid desiccant tank configured for holding liquid desiccant upstream of one of the mass exchange devices 220, 240. In the embodiment illustrated in FIG. 2, a first liquid desiccant tank 420 is located between the heat exchanger 320 and the first mass exchange device 220. The first liquid desiccant tank 420 is in fluid communication with both components, receiving liquid desiccant from the heat exchanger 320 and providing liquid desiccant to the first mass exchange device 220. The first liquid desiccant tank 420 may be integral with the first mass exchange device 220, and both components may be enclosed by a first housing (not shown).

Similarly, a second liquid desiccant tank 440 is located between the heat exchanger 320 and the second mass exchange device 240. The second liquid desiccant tank 440 is in fluid communication with both components, receiving liquid desiccant from the heat exchanger 320 and providing it to the second mass exchange device 240. The second liquid desiccant tank 440 may be integral with the second mass exchange device 240, and both components may be enclosed by a second housing (not shown).

The volume of liquid desiccant in each of the first and second liquid desiccant tanks 420, 440 can be constant; that is, liquid desiccant is received from the heat exchanger 320 at the same rate as it is provided to the first or second mass exchange device 220, 240. Alternatively, the volume of liquid desiccant in each tank 420, 440 may vary over time to allow precise control of the rate at which liquid desiccant is provided to the first or second mass exchange device 220, 240.

At least one pump 210 is fluidly coupled to the first mass exchange device 220, the second mass exchange device 240, and the liquid desiccant heat exchanger 320. The at least one pump 210 is configured to circulate liquid desiccant in a loop through the conditioning process in the first mass exchange device 220 and the regeneration process in the second mass exchange device 240. The embodiment illustrated in FIG. 2 includes two pumps 210, but the humidity control system 200 may include any suitable number of pumps 210, for example and without limitation, one, three, or more.

Each of the pumps 210 in FIG. 2 is located downstream of one of the first or second liquid desiccant tank 420, 440. Each pump 210 is operable to control the rate at which liquid desiccant is supplied from the liquid desiccant tank 420, 440 to the mass exchange device 220, 240. The integration of a liquid desiccant tank and a pump with each mass exchange device simplifies the system's piping and storage capabilities, and allows for the fluid pressure of the liquid desiccant within each mass exchange device to be controlled within a small pressure range. The at least one pump 210 may be a centrifugal pump, diaphragm pump, reciprocating pump, vane pump, screw pump, gear pump, or any type of pump that allows the humidity control system 200 to function as described herein.

The humidity control system 200 can additionally include a three-way valve 480 located downstream of the first mass exchange device 220. The three-way valve 480 can be configured in a first, fully closed position, in which all liquid desiccant flows from the first mass exchange device 220 to the first path 330 of the heat exchanger 320. The three-way valve 480 can alternatively be configured in a second, partially open position, in which a portion of the liquid desiccant cooled in the first mass exchange device 220 is diverted to the first liquid desiccant tank 420 to provide the first mass exchange device 220 with pre-cooled liquid desiccant. The remainder of the liquid desiccant flows through the first path 330 of the heat exchanger 320.

In some embodiments, the humidity control system can be used to humidify, rather than dehumidify, the conditioned interior space 50 to provide evaporative cooling. In such embodiments, the three-way valve 480 can additionally be configured in a third position, in which the second mass exchange device 240 and the heat exchanger 320 are fully bypassed, and all of the liquid desiccant exiting the first mass exchange device 220 is routed back to the first liquid desiccant tank 420. In such embodiments, the first liquid desiccant tank 420 can include a connection 426 to receive water from an external water source, thereby diluting the liquid desiccant with water to be released into the conditioned interior space. The external water source can be a municipal water source, a well, or any other suitable source. Further embodiments do not include a connection to receive water from an external water source.

Figure 7:
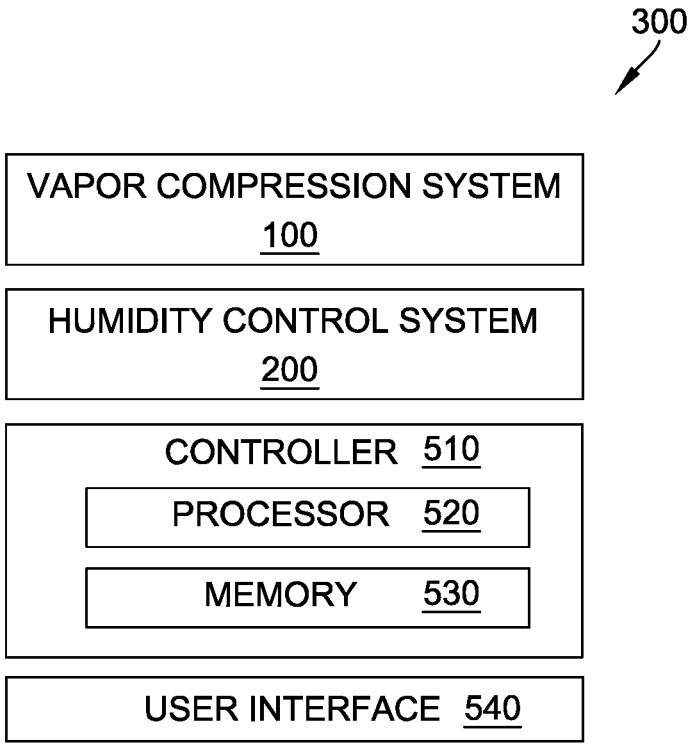
FIG. 7 is a block diagram of a control system for the conditioning system shown in FIG. 3.

With reference to FIG. 7, the conditioning system 300 includes a controller 510 for controlling the temperature and humidity of the conditioned interior space 50. The controller 510 includes a processor 520 and a memory 530. The memory 530 stores instructions that program the processor 520 to operate the vapor compression system 100 to control the temperature of the conditioned interior space 50 to a temperature setpoint, and to operate the humidity control system 200 in conjunction with the vapor compression system 100 to control the humidity in the conditioned interior space 50 to a humidity setpoint. The controller 510 is configured to control at least one operating parameter of the conditioning system 300, for example and without limitation, a speed of the first or second fan 150, 190, a position of the three-way valve 480, a speed of the compressor 160, or a speed of the at least one pump 210. The controller 510 can control these parameters in response to at least one measured or calculated property of the air in the conditioned interior space 50, for example and without limitation, a dew point temperature, wet bulb temperature, partial pressure of water vapor, or humidity ratio.

The conditioning system 300 further includes a user interface 540 configured to output (e.g., display) and/or receive information (e.g., from a user) associated with the conditioning system 300. In some embodiments, the user interface 540 is configured to receive an activation and/or deactivation input from a user to activate and deactivate (i.e., turn on and off) or otherwise enable operation of the conditioning system 300. For example, the user interface 540 can receive a temperature setpoint and a humidity setpoint specified by the user. Moreover, in some embodiments, the user interface 540 is configured to output information associated with one or more operational characteristics of the conditioning system 300, including, for example and without limitation, warning indicators such as severity alerts, occurrence alerts, fault alerts, motor speed alerts, and any other suitable information.

The user interface 540 may include any suitable input devices and output devices that enable the user interface 540 to function as described herein. For example, the user interface 540 may include input devices including, but not limited to, a keyboard, mouse, touchscreen, joystick(s), throttle(s), buttons, switches, and/or other input devices. Moreover, the user interface 540 may include output devices including, for example and without limitation, a display (e.g., a liquid crystal display (LCD) or an organic light emitting diode (OLED) display), speakers, indicator lights, instruments, and/or other output devices. Furthermore, the user interface 540 may be part of a different component, such as a system controller (not shown). Other embodiments do not include a user interface 540.

The controller 510 is generally configured to control operation of the conditioning system 300. The controller 510 controls operation through programming and instructions from another device or controller or is integrated with the conditioning system 300 through a system controller. In some embodiments, for example, the controller 510 receives user input from the user interface 540, and controls one or more components of the conditioning system 300 in response to such user inputs. For example, the controller 510 may control the first fan 150 based on user input received from the user interface 540. In some embodiments, the conditioning system 300 may be controlled by a remote control interface. For example, the conditioning system 300 may include a communication interface (not shown) configured for connection to a wireless control interface that enables remote control and activation of the conditioning system 300. The wireless control interface may be embodied on a portable computing device, such as a tablet or smartphone.

The controller 510 may generally include any suitable computer and/or other processing unit, including any suitable combination of computers, processing units and/or the like that may be communicatively coupled to one another and that may be operated independently or in connection within one another (e.g., controller 510 may form all or part of a controller network). Controller 510 may include one or more modules or devices, one or more of which is enclosed within the conditioning system 300, or may be located remote from the conditioning system 300. The controller 510 may be part of the vapor compression system 100, the humidity control system 200, or separate and may be part of a system controller in an HVAC system. Controller 510 and/or components of controller 510 may be integrated or incorporated within other components of the conditioning system 300. The controller 510 may include one or more processor(s) 520 and associated memory device(s) 530 configured to perform a variety of computer-implemented functions (e.g., performing the calculations, determinations, and functions disclosed herein).

As used herein, the term "processor" refers not only to integrated circuits, but also to a controller, a microcontroller, a microcomputer, a programmable logic controller (PLC), an application-specific integrated circuit, and other programmable circuits. Additionally, memory device(s) 530 of controller 510 may generally be or include memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) 530 may generally be configured to store suitable computer-readable instructions that, when implemented by the processor(s) 520, configure or cause the controller 510 to perform various functions described herein including, but not limited to, controlling the conditioning system 300, receiving inputs from user interface 540, providing output to an operator via user interface 540, and/or various other suitable computer-implemented functions.

Technical benefits of the systems described herein are as follows: (1) The temperature and humidity of an indoor space can be separately regulated by preconditioning air to a temperature above its dew point temperature and dehumidifying the preconditioned air using a liquid desiccant loop, and (2) the liquid desiccant can effectively absorb and release moisture through the vapor permeable membrane without contaminating the airflow with corrosive liquid desiccant.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a," "an," "the," and "said" are intended to mean that there are one or more of the elements. The terms "comprising," "including," "containing," and "having" are intended to be inclusive and mean that there may be additional elements other than the listed elements. The use of terms indicating a particular orientation (e.g., "top," "bottom," "side," etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A conditioning system comprising:

a vapor compression system including:

an evaporator, a condenser, a first fan for producing a first airflow across the evaporator toward a conditioned interior space, and a second fan for producing a second airflow from the condenser toward an exterior space; and a humidity control system including:

a first mass exchange device positioned in the first airflow downstream from the evaporator, the first mass exchange device including a plurality of first cavities each configured to permit a flow of a liquid desiccant from an inlet of the first mass exchange device to an outlet of the first mass exchange device, wherein each first cavity of the first mass exchange device has a U-shaped cross section from the inlet to the outlet perpendicular to a direction of the flow of fluid desiccant, wherein the U-shaped cross section defines an open portion exposed to the first airflow, and the open portion of each first cavity is covered by a first vapor permeable membrane, a second mass exchange device positioned in the second airflow downstream from the condenser, the second mass exchange device including a plurality of second cavities each configured to permit a flow of the liquid desiccant from an inlet of the second mass exchange device to an outlet of the second mass exchange device, wherein each second cavity of the second mass exchange device has a U-shaped cross section from the inlet to the outlet perpendicular to a direction of the flow of fluid desiccant, wherein the U-shaped cross section defines an open portion exposed to the second airflow, and the open portion of each second cavity is covered by a second vapor permeable membrane, and a liquid desiccant heat exchanger coupled in fluid communication with the first mass exchange device and the second mass exchange device, the liquid desiccant heat exchanger including a first path for providing liquid desiccant in a first direction from the first mass exchange device to the second mass exchange device, and a second path adjacent the first path for providing liquid desiccant in a second direction from the second mass exchange device to the first mass exchange device, wherein the first path is thermally coupled to the second path.

2. The conditioning system of claim 1, wherein the first mass exchange device includes an inlet and an outlet, the second mass exchange device includes an inlet and an outlet, the first path is in fluid communication with the outlet of the first mass exchange device and the inlet of the second mass exchange device, the second path is in fluid communication with the outlet of the second mass exchange device and the inlet of the first mass exchange device.

3. The conditioning system of claim 1, wherein the humidity control system further comprises a first liquid desiccant tank configured for holding liquid desiccant, and a second liquid desiccant tank configured for holding liquid desiccant, wherein the first liquid desiccant tank is in fluid communication with the first mass exchange device and the second liquid desiccant tank is in fluid communication with the second mass exchange device.

4. The conditioning system of claim 3, wherein the first liquid desiccant tank is integral with the first mass exchange device and the second liquid desiccant tank is integral with the second mass exchange device.

5. The conditioning system of claim 4, wherein the first liquid desiccant tank is located between the liquid desiccant heat exchanger and the first mass exchange device to receive liquid desiccant from the liquid desiccant heat exchanger and provide liquid desiccant to the first mass exchange device, and the second liquid desiccant tank is located between the liquid desiccant heat exchanger and the second mass exchange device to receive liquid desiccant from the liquid desiccant heat exchanger and provide liquid desiccant to the second mass exchange device.

6. The conditioning system of claim 4, wherein the humidity control system further comprises at least one pump configured to circulate liquid desiccant between the first mass exchange device, the liquid desiccant heat exchanger, and the second mass exchange device.

7. The conditioning system of claim 1, wherein the first direction and the second direction are opposite parallel directions.

8. The conditioning system of claim 1, further comprising a controller, the controller programmed to operate the vapor compression system to control a temperature in the conditioned interior space to a temperature setpoint, and to operate the humidity control system in conjunction with the vapor compression system to control a humidity in the conditioned interior space to a humidity setpoint.

9. The conditioning system of claim 1, wherein the humidity control system does not include a connection to receive water from an external water source.

10. A humidity control system for use in a vapor compression system including an evaporator and a condenser, the humidity control system comprising:

a first mass exchange device configured to be positioned in a first airflow downstream from the evaporator and upstream from a conditioned interior space, the first mass exchange device including at least one first cavity configured to permit a flow of a liquid desiccant from an inlet of the first mass exchange device to an outlet of the first mass exchange device, wherein each first cavity of the first mass exchange device has a U-shaped cross section from the inlet to the outlet perpendicular to a direction of the flow of fluid desiccant, wherein the U-shaped cross section defines an open portion exposed to the first airflow, and the open portion of each first cavity is covered by a first vapor permeable membrane;

a second mass exchange device configured to be positioned in a second airflow downstream from the condenser and upstream from an exterior space, the second mass exchange device including at least one second cavity configured to permit a flow of the liquid desiccant from an inlet of the second mass exchange device to an outlet of the second mass exchange device, wherein each second cavity of the second mass exchange device has a U-shaped cross section from the inlet to the outlet perpendicular to a direction of the flow of fluid desiccant, wherein the U-shaped cross section defines an open portion exposed to the second airflow, and the open portion of each second cavity is covered by a second vapor permeable membrane; and a liquid desiccant heat exchanger coupled in fluid communication with the first mass exchange device and the second mass exchange device, the liquid desiccant heat exchanger including a first path for providing liquid desiccant in a first direction from the first mass exchange device to the second mass exchange device, and a second path adjacent the first path for providing liquid desiccant in a second direction from the second mass exchange device to the first mass exchange device, wherein the first path is thermally coupled to the second path.

11. The humidity control system of claim 10, wherein the first mass exchange device includes an inlet and an outlet, the second mass exchange device includes an inlet and an outlet, the first path is in fluid communication with the outlet of the first mass exchange device and the inlet of the second mass exchange device, and the second path is in fluid communication with the outlet of the second mass exchange device and the inlet of the first mass exchange device.

12. The humidity control system of claim 10, further comprising a first liquid desiccant tank configured for holding liquid desiccant, and a second liquid desiccant tank configured for holding liquid desiccant, wherein the first liquid desiccant tank is in fluid communication with the first mass exchange device and the second liquid desiccant tank is in fluid communication with the second mass exchange device.

13. The humidity control system of claim 12, wherein the first liquid desiccant tank is integral with the first mass exchange device and the second liquid desiccant tank is integral with the second mass exchange device.

14. The humidity control system of claim 12, wherein the first liquid desiccant tank is located between the liquid desiccant heat exchanger and the first mass exchange device to receive liquid desiccant from the liquid desiccant heat exchanger and provide liquid desiccant to the first mass exchange device, and the second liquid desiccant tank is located between the liquid desiccant heat exchanger and the second mass exchange device to receive liquid desiccant from the liquid desiccant heat exchanger and provide liquid desiccant to the second mass exchange device.

15. The humidity control system of claim 10, further comprising at least one pump configured to circulate liquid desiccant between the first mass exchange device, the liquid desiccant heat exchanger, and the second mass exchange device.

16. The humidity control system of claim 10, wherein the first direction and the second direction are opposite parallel directions.

17. The humidity control system of claim 10, wherein the humidity control system does not include a connection to receive water from an external water source.

18. The humidity control system of claim 10, further comprising a controller, the controller programmed to operate the humidity control system in conjunction with the vapor compression system to control a humidity in the conditioned interior space to a humidity setpoint.

19. The conditioning system of claim 1, wherein the system is configured such that liquid desiccant in each first cavity of the first mass exchange device flows in a direction opposite to a direction of the first airflow, and liquid desiccant in each second cavity of the second mass exchange device flows in a direction parallel to a direction of the second airflow.

20. The humidity control system of claim 10, wherein the system is configured such that liquid desiccant in each first cavity of the first mass exchange device flows in a direction opposite to a direction of the first airflow, and liquid desiccant in each second cavity of the second mass exchange device flows in a direction parallel to a direction of the second airflow.

* * * * *